US011659640B2

(12) United States Patent
Zheng et al.

(10) Patent No.: US 11,659,640 B2
(45) Date of Patent: May 23, 2023

(54) LIGHTING APPARATUS

(71) Applicant: LEEDARSON LIGHTING CO., LTD., Fujian (CN)

(72) Inventors: Yisheng Zheng, Fujian (CN); Qiqiang Lin, Fujian (CN); Hemu Ye, Fujian (CN); Yibin Chen, Fujian (CN); Zongyuan Liu, Fujian (CN); Yankun Li, Fujian (CN)

(73) Assignee: LEEDARSON LIGHTING CO., LTD., Fujian (CN)

( * ) Notice: Subject to any disclaimer, the term of this patent is extended or adjusted under 35 U.S.C. 154(b) by 0 days.

(21) Appl. No.: 17/584,856

(22) Filed: Jan. 26, 2022

(65) Prior Publication Data

US 2022/0240359 A1 Jul. 28, 2022

(30) Foreign Application Priority Data

Jan. 28, 2021 (CN) ..... 202110120401.0

(51) Int. Cl.

| | |
|---|---|
| ***H05B 45/36*** | (2020.01) |
| ***H05B 47/19*** | (2020.01) |
| ***H05B 45/10*** | (2020.01) |
| ***H05B 45/20*** | (2020.01) |

(52) U.S. Cl.

CPC ..... *H05B 45/36* (2020.01); *H05B 45/20* (2020.01); *H05B 47/19* (2020.01)

(58) Field of Classification Search

None

See application file for complete search history.

(56) References Cited

U.S. PATENT DOCUMENTS

2012/0256553 A1* 10/2012 Chen ..... H05B 45/10 315/205

FOREIGN PATENT DOCUMENTS

CN 210351730 U * 4/2020
CN 210986491 U * 7/2020

* cited by examiner

*Primary Examiner* — Dedei K Hammond

(74) *Attorney, Agent, or Firm* — Chun-Ming Shih; Lanway IPR Services

(57) ABSTRACT

A lighting apparatus includes a light source, a silicon controlled rectifier, a rectifier and a current source circuit. The light source has multiple LED modules with different light parameters. The silicon controlled rectifier filters a filtering ratio of an input AC power to a filtered AC power. The filtering ratio is associated with a control angle by supplying a control voltage to the silicon controlled rectifier. The maintainer circuit maintains a working current to the silicon controlled rectifier even when the control angle is large causing the volume of the filtered AC power less than a threshold. The current source circuit receives the DC power. The current source circuit has a wall switch input for connecting to a wall switch. An on-off input pattern of the wall switch is detected by the current source circuit for generating multiple corresponding driving currents.

20 Claims, 7 Drawing Sheets

LIGHTING APPARATUS

FIELD

The present invention is related to a lighting apparatus, and more particularly related to a lighting apparatus with a flexible control interface.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Lighting devices are widely used in various places. It is important to provide a flexible control to light devices.

Even wireless control is more and more popular in current light device design, it is still very important to keep a wall switch. When the LED technology allows color mixing, it is favorable to provide a control by the wall switch. In addition, the light intensity is usually provided via a rotation switch.

It is therefore important to find a way to integrate multiple control methods in a compact light device design. Lighting devices are widely used in various places. It is important to provide a flexible control to light devices.

Even wireless control is more and more popular in current light device design, it is still very important to keep a wall switch. When the LED technology allows color mixing, it is favorable to provide a control by the wall switch. In addition, the light intensity is usually provided via a rotation switch.

It is therefore important to find a way to integrate multiple control methods in a compact light device design. Lighting devices are widely used in various places. It is important to provide a flexible control to light devices.

Even wireless control is more and more popular in current light device design, it is still very important to keep a wall switch. When the LED technology allows color mixing, it is favorable to provide a control by the wall switch. In addition, the light intensity is usually provided via a rotation switch.

It is therefore important to find a way to integrate multiple control methods in a compact light device design. Lighting devices are widely used in various places. It is important to provide a flexible control to light devices.

Even wireless control is more and more popular in current light device design, it is still very important to keep a wall switch. When the LED technology allows color mixing, it is favorable to provide a control by the wall switch. In addition, the light intensity is usually provided via a rotation switch.

It is therefore important to find a way to integrate multiple control methods in a compact light device design.

SUMMARY

In some embodiments, a lighting apparatus includes a light source, a silicon controlled rectifier, a rectifier and a current source circuit.

The light source has multiple LED modules with different light parameters.

The silicon controlled rectifier filters a filtering ratio of an input AC power to a filtered AC power.

The filtering ratio is associated with a control angle by supplying a control voltage to the silicon controlled rectifier.

The control angle determines a volume of the filtered AC power.

The rectifier is coupled to the silicon controlled rectifier for converting the filtered AC power to a DC power.

The maintainer circuit maintains a working current to the silicon controlled rectifier even when the control angle is large causing the volume of the filtered AC power less than a threshold.

The current source circuit receives the DC power.

The current source circuit has a wall switch input for connecting to a wall switch.

An on-off input pattern of the wall switch is detected by the current source circuit for generating multiple corresponding driving currents respectively supplied to the multiple LED modules to generate a mixed light parameter.

In some embodiments, the rectifier is a bridge rectifier with a bridge input end coupled to the filtered AC power of the silicon controlled rectifier.

In some embodiments, the silicon controlled rectifier has three terminals.

One of the three terminals receives the control voltage.

In some embodiments, the silicon controlled rectifier is turned on by the control voltage to allow the volume of the filtered AC power to pass through the silicon controlled rectifier.

In some embodiments, when the silicon controlled rectifier is turned on, a basic current is needed to keep the silicon controlled rectifier to be turned on.

The working current is larger than the basic current.

In some embodiments, the working current keeps the silicon controlled rectifier to be stable on turning on even when the volume of the filtered AC power less than the threshold.

In some embodiments, the maintainer circuit includes a compatible circuit and a maintaining power circuit.

The maintaining power circuit receives the DC power to generate the working current.

In some embodiments, the compatible circuit includes a capacitor and a resistor connected in series.

In some embodiments, the on-off pattern is a series of predetermined turn-on and turn-off operations applied to the wall switch.

In some embodiments, the series of predetermined turn-on and turn-off operations are performed within an operation time period.

In some embodiments, there are multiple sets of the on-off patterns corresponding to multiple settings for operating the multiple LED modules.

In some embodiments, a different time gap between turn-on and turn-off operations of the wall switch is associated to the different mixed light parameter.

In some embodiments, the mixed light parameter is a color temperature setting.

In some embodiments, the mixed light parameter is a color setting.

In some embodiments, the current source circuit has a controller for determining the multiple driving currents according to a table.

The table records parameters of the silicon controlled rectifier and the on-off pattern.

In some embodiments, the table is adjustable according to different silicon controlled rectifier and different LED modules.

In some embodiments, the current source circuit automatically adjusts the table according to the connected silicon controlled rectifier when the current source circuit is in a reset procedure.

In some embodiments, a bypass path is connecting the rectifier and the input AC power to selectively bypass the silicon controlled rectifier.

In some embodiments, the silicon controlled rectifier is a TRIAC component.

In some embodiments, the lighting apparatus may also include a wireless circuit for receiving an external command to bypass an operation of the wall switch.

DETAILED DESCRIPTION

Figure 5:
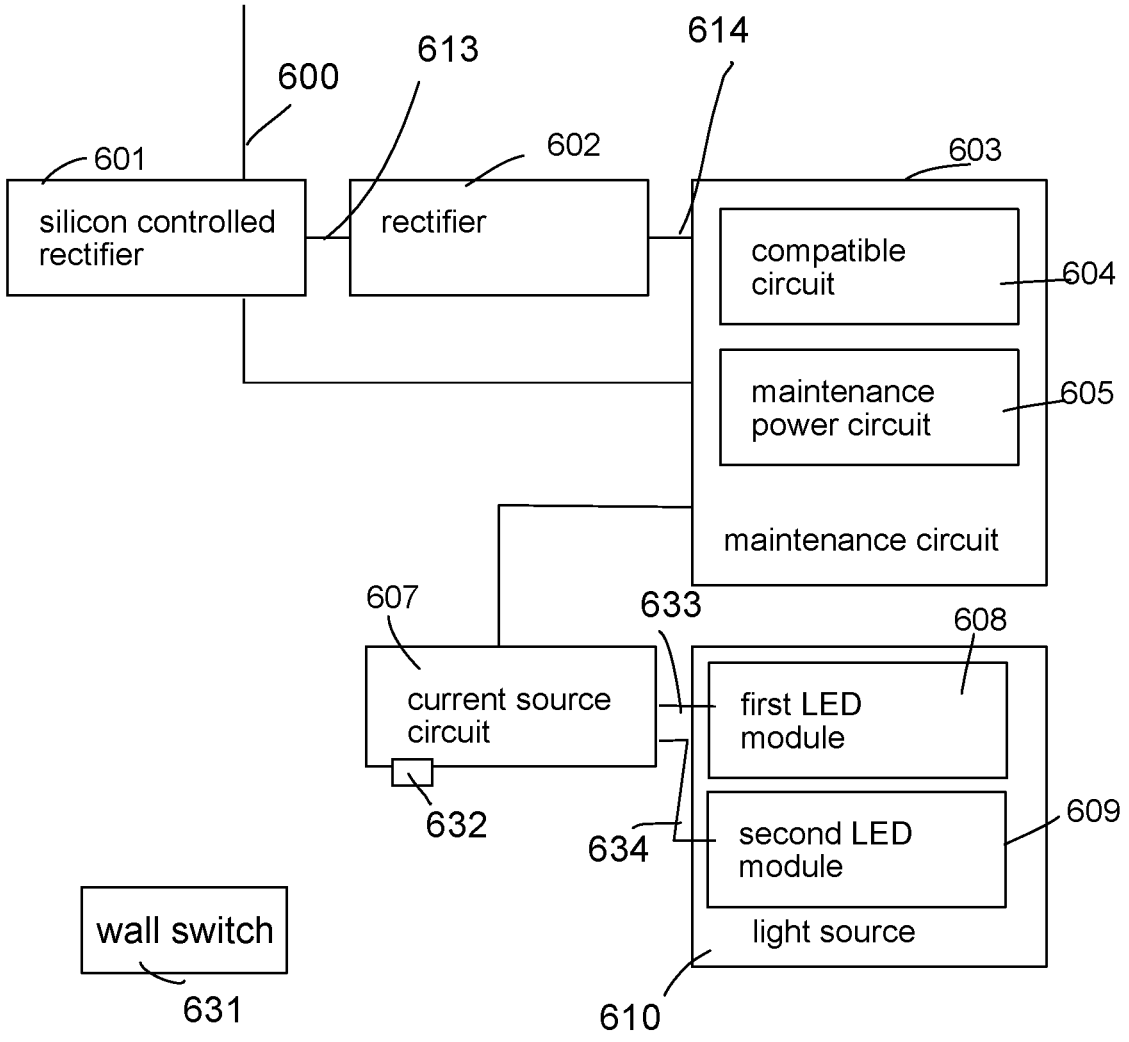
FIG. 5 shows a lighting apparatus circuit example.

In FIG. 5, a lighting apparatus includes a light source 610, a silicon controlled rectifier 601, a rectifier 602 and a current source circuit 607.

The light source 610 has multiple LED modules, e.g. the first LED module 608 and the second LED module 609, with different light parameters. For example, the first LED module 608 and the second LED module 609 emit lights of different colors and/or different color temperatures. By supplying different ratios of currents to the first LED module 608 and the second LED module 609, a different light parameter is mixed. More than two types of LED modules may be disposed in the light source 610.

The silicon controlled rectifier 601 filters a filtering ratio of an input AC power 600 to a filtered AC power 613.

The filtering ratio is associated with a control angle by supplying a control voltage to the silicon controlled rectifier.

Figure 6:
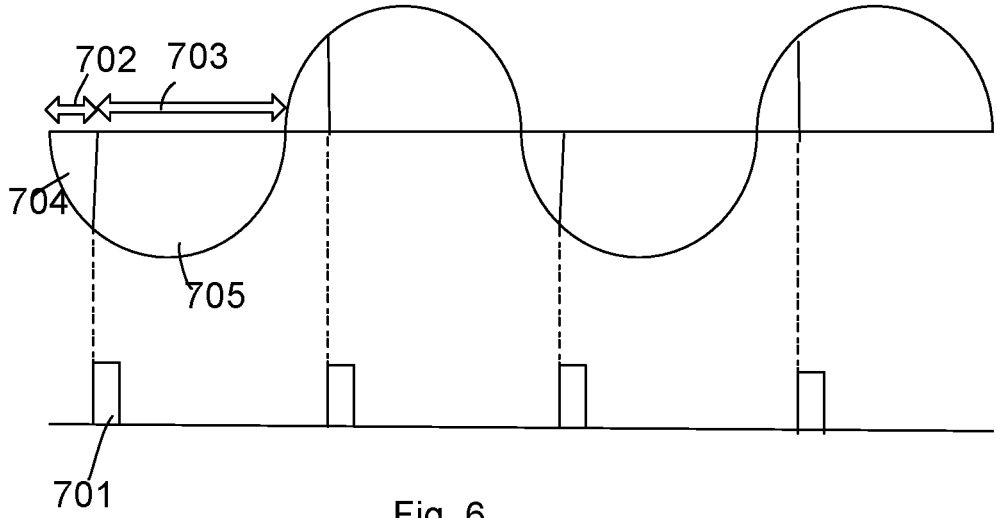
FIG. 6 shows a control angle diagram.

Please refer to FIG. 6. FIG. 6 shows a control example of a silicon controlled rectifier. In FIG. 6, a control voltage 701 is turned in a desired timing. For AC power source, a repeated sine pattern of voltage changes is illustrated as shown in FIG. 6. For each period, there are 360 degrees. Before the control voltage 701 is raised, the silicon controlled rectifier stops the input AC power to pass through. When the control voltage 701 is raised, the input AC power is allowed to pass as a filtered AC power. The filtered AC power is a partial amount of the overall input AC power. Specifically, the input AC power 704 is filtered while the other input AC power 705 is allowed to pass.

The filtered AC power is corresponding to the control angle 702, e.g. 30 degrees, compared with a conductive angle 703, e.g. 150 degrees. The control angle 702 and the conductive angle 703 together are summed 180 degrees for a half circle of a AC power period.

As illustrated in FIG. 6, the control angle determines a volume of the filtered AC power.

In FIG. 5, the rectifier 602 is coupled to the silicon controlled rectifier 601 for converting the filtered AC power 613 to a DC power 614.

The maintainer circuit 603 maintains a working current to the silicon controlled rectifier 601 even when the control angle is large causing the volume of the filtered AC power less than a threshold, e.g. less than 10% of a complete input AC power amount.

The current source circuit 607 receives the DC power 614.

The current source circuit 607 has a wall switch input 632 for connecting to a wall switch 631. The wall switch 631 is mounted on a wall with a wire or a wireless connection to the wall switch input 632 of the current source circuit 632.

An on-off input pattern of the wall switch is detected by the current source circuit 607 for generating multiple corresponding driving currents 633, 634 respectively supplied to the multiple LED modules 608, 609 to generate a mixed light parameter.

In some embodiments, the rectifier 602 is a bridge rectifier with a bridge input end coupled to the filtered AC power 613 of the silicon controlled rectifier 601.

Figure 3:
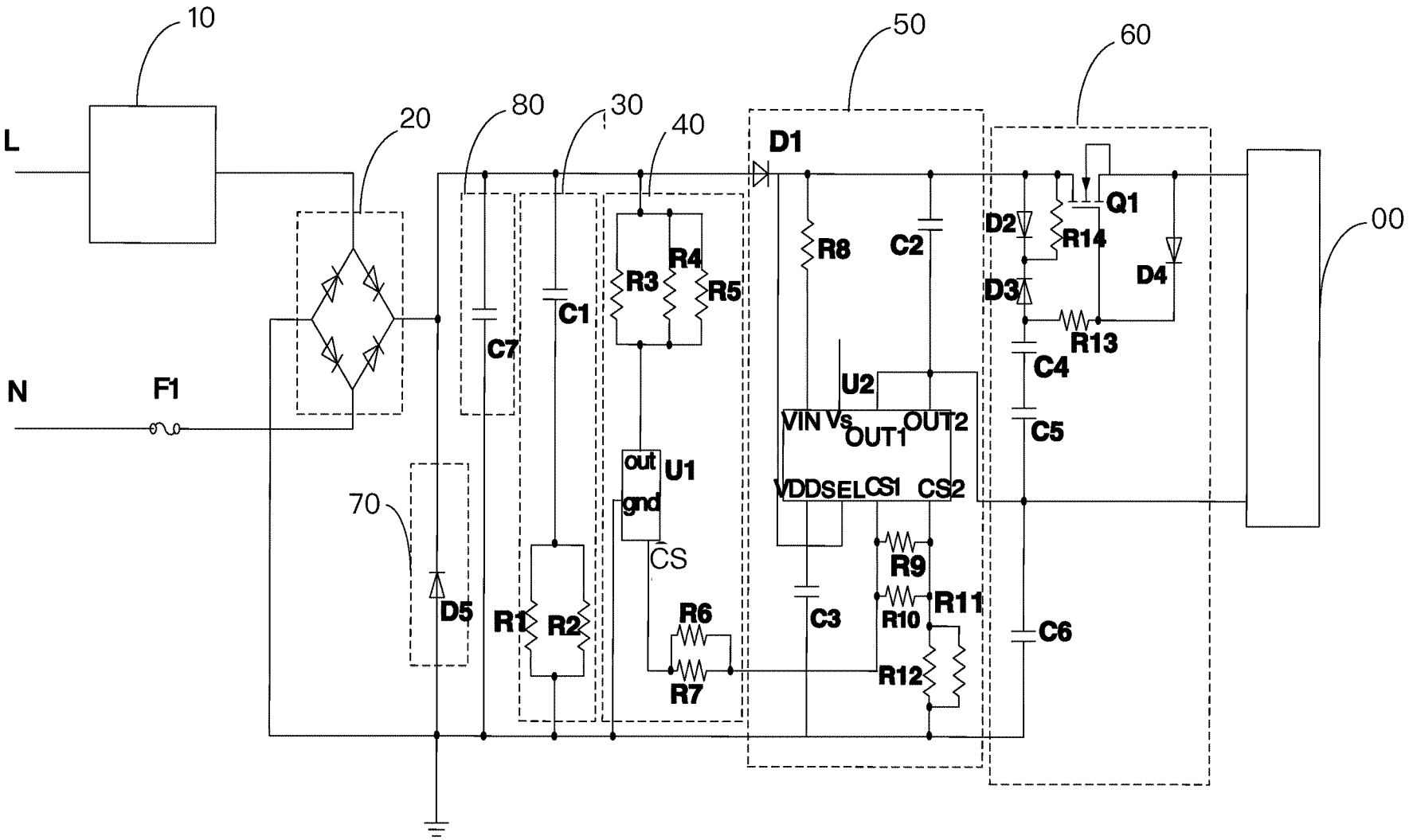
FIG. 3 illustrates a detailed circuit example of a lighting apparatus embodiment.

Please refer to FIG. 3, the rectifier 20 is a bridge rectifier for converting an AC input to a DC output.

Figure 1:
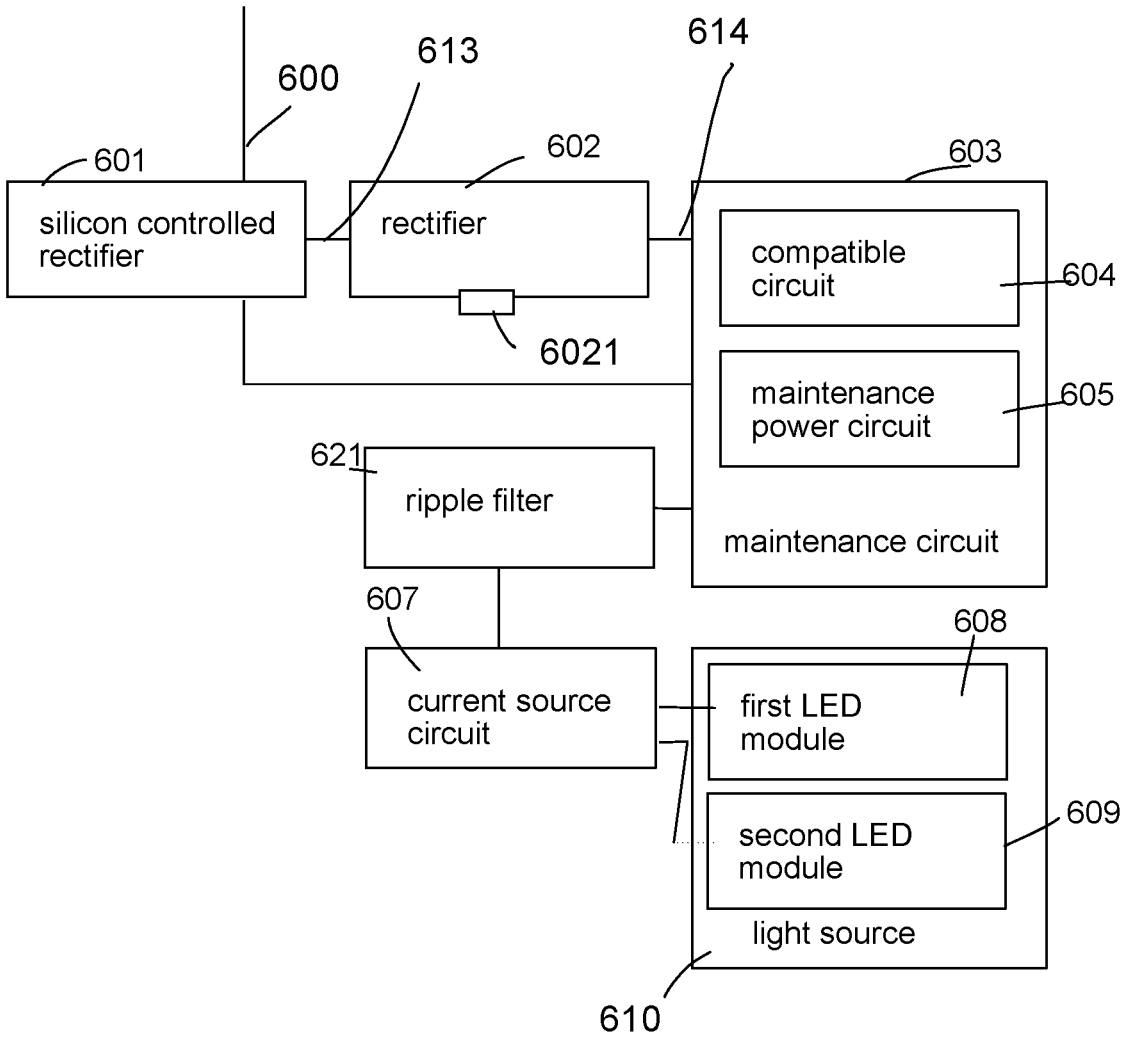
FIG. 1 illustrates a circuit embodiment of a lighting apparatus.

In FIG. 1, the silicon controlled rectifier has three terminals. One of the three terminals 6021 receives the control voltage. The terminal may be connected to a manual switch to generate a continuous value of control voltage.

In some embodiments, the silicon controlled rectifier is turned on by the control voltage to allow the volume of the filtered AC power to pass through the silicon controlled rectifier.

In some embodiments, when the silicon controlled rectifier is turned on, a basic current is needed to keep the silicon controlled rectifier to be turned on. For example, some TRIAC are used and need 3-10 mA to keep a normal operation. Some TRIAC may need 100 to 1000 A to keep a normal operation.

The working current is larger than the basic current.

In some embodiments, the working current keeps the silicon controlled rectifier to be stable on turning on even when the volume of the filtered AC power less than the threshold.

In FIG. 1, the maintainer circuit 603 includes a compatible circuit 604 and a maintaining power circuit 605.

The maintaining power circuit 603 receives the DC power to generate the working current.

In FIG. 3, the compatible circuit 30 includes a capacitor C1 and a resistor R1, R2 connected in series.

In FIG. 3, the maintenance power circuit 40 has resistors R3, R4, R5 connected in parallel connecting to a chip U1. Another two resistors R6 and R7 are also connected to the chip U1 for generating a working current to the silicon controlled rectifier 10.

In FIG. 3, the current source circuit 50 has a resistor R8, a capacitor C2, a capacitor C3, resistors R9, R10, R11, R12 connected to a chip U2 for generating driving currents.

In some embodiments, the on-off pattern is a series of predetermined turn-on and turn-off operations applied to the wall switch. For example, when users turn on and then turn off the wall switch within two seconds, the on-off pattern may be defined and associated with an operation of color temperature switch. Each such on-off pattern may cause the current source circuit to change to a next color temperature setting by supplying different driving currents to different LED modules.

In some embodiments, the series of predetermined turn-on and turn-off operations are performed within an operation time period.

In some embodiments, there are multiple sets of the on-off patterns corresponding to multiple settings for operating the multiple LED modules.

In some embodiments, a different time gap between turn-on and turn-off operations of the wall switch is associated to the different mixed light parameter. For example, a time gap between two consecutive on-off operation may correspond a level of color temperature change. A longer time gap may be associated to a larger change.

In some embodiments, the mixed light parameter is a color temperature setting.

In some embodiments, the mixed light parameter is a color setting.

In some embodiments, the current source circuit has a controller for determining the multiple driving currents according to a table.

Figure 7:
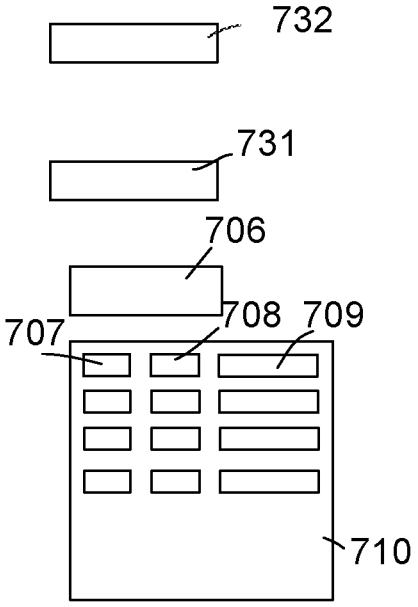
FIG. 7 shows a table control design.

In FIG. 7, a control circuit 706 in the current source circuit may retrieve a table 710. The table 710 records a parameter 707 of the silicon controlled rectifier, a parameter 708 of a wall switch operation and a corresponding output driving currents 709.

The table records parameters of the silicon controlled rectifier and the on-off pattern.

In some embodiments, the table is adjustable according to different silicon controlled rectifier and different LED modules.

In some embodiments, the current source circuit automatically adjusts the table according to the connected silicon controlled rectifier when the current source circuit is in a reset procedure. For example, a reset button may be provided to activate the adjustment.

In some embodiments, a bypass path is connecting the rectifier and the input AC power to selectively bypass the silicon controlled rectifier. In other words, the input AC power may be supplied to the rectifier instead of passing through the silicon controlled rectifier.

In some embodiments, the silicon controlled rectifier may be provided by another source and is separate outside the lighting apparatus.

In some embodiments, the silicon controlled rectifier is a TRIAC component.

In FIG. 7, the lighting apparatus may also include a wireless circuit 731 for receiving an external command from a remote device 732 to bypass an operation of the wall switch.

Figure 2:
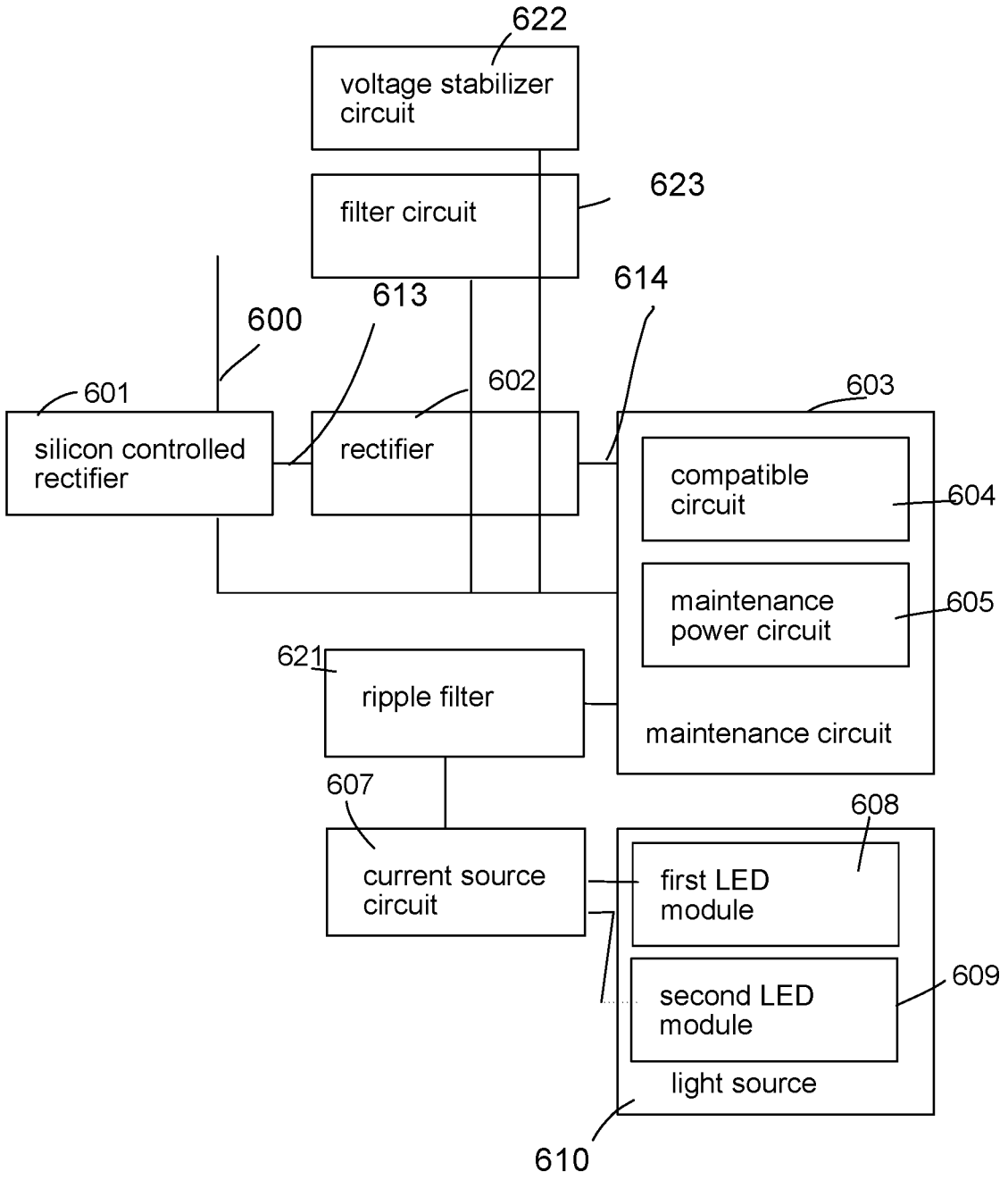
FIG. 2 illustrates another circuit embodiment of the lighting apparatus.

In FIG. 2, another lighting apparatus embodiment is provided. In FIG. 2, a voltage stabilizer circuit 622 and a filter circuit 623 are provided to keep the voltage stable and to remove undesired noise. In addition, a ripple filter 621 is used for removing ripple wave from the current to keep the output light more stable.

FIG. 3 shows a Zener diode D5 used to be the stabilizer circuit 70. FIG. 3 shows a capacitor C7 as the filter circuit 80.

FIG. 3 shows a combination of transistor Q1, Zener diodes D2, D3, D4, resistors R13, R14, capacitors C4, C5 forming the ripple filter 60. The light source 00 receives multiple driving currents to emit light of mixed light parameters as mentioned above.

Figure 4:
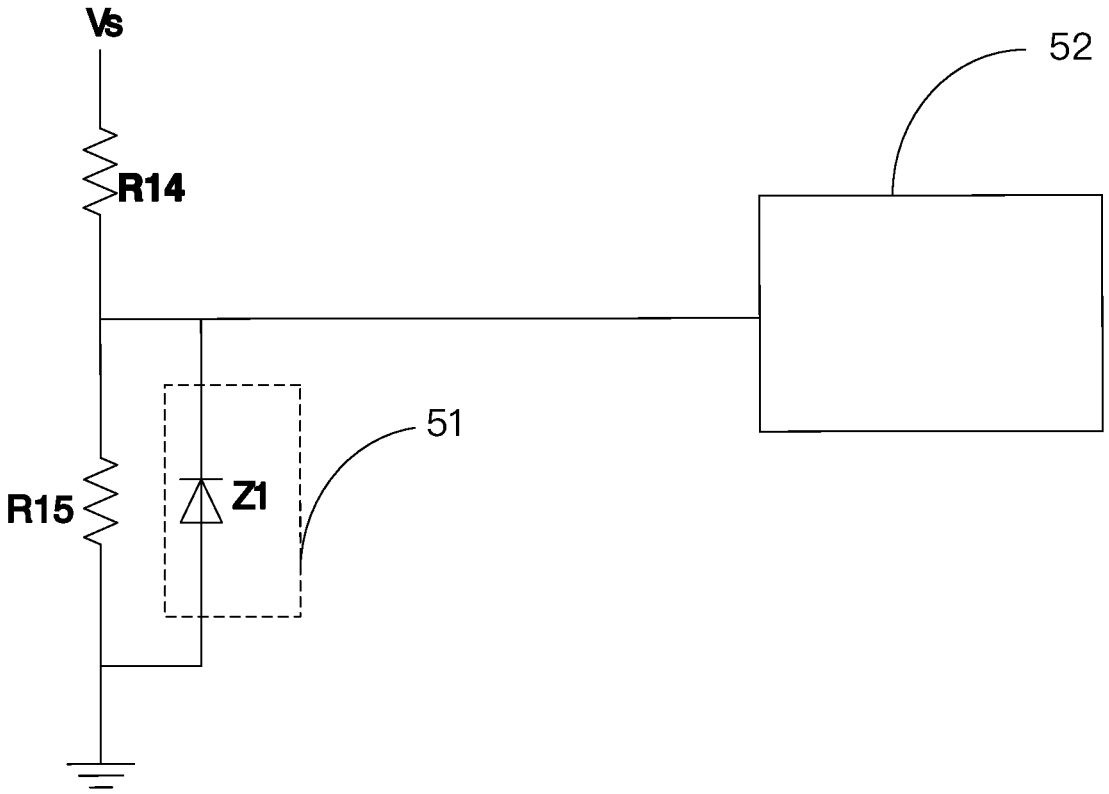
FIG. 4 illustrates a wall switch mode selection unit.

FIG. 4 shows a mode switch 52 connected to a stabilizer 51 coupled to two resistors R14, R15 for providing a wall switch control.

The foregoing description, for purpose of explanation, has been described with reference to specific embodiments.

However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source with multiple LED modules with different light parameters;

a silicon controlled rectifier for filtering a filtering ratio of an input AC power to a filtered AC power, wherein the filtering ratio is associated with a control angle by supplying a control voltage to the silicon controlled rectifier, wherein the control angle determines a volume of the filtered AC power;

a rectifier coupled to the silicon controlled rectifier for converting the filtered AC power to a DC power;

a maintainer circuit for maintaining a working current for the silicon controlled rectifier when the control angle reduces the volume of the filtered AC power below a threshold; and a current source circuit for receiving the DC power, wherein the current source circuit has a wall switch input for connecting to a wall switch, wherein an on-off input pattern of the wall switch is detected by the current source circuit for generating multiple corresponding driving currents respectively supplied to the multiple LED modules to generate a mixed light parameter.

2. The lighting apparatus of claim 1, wherein the rectifier is a bridge rectifier with a bridge input end coupled to the filtered AC power of the silicon controlled rectifier.

3. The lighting apparatus of claim 1, wherein the silicon controlled rectifier has three terminals, wherein one of the three terminals receives the control voltage.

4. The lighting apparatus of claim 3, wherein the silicon controlled rectifier is turned on by the control voltage to allow the volume of the filtered AC power to pass through the silicon controlled rectifier.

5. The lighting apparatus of claim 4, wherein when the silicon controlled rectifier is turned on, a basic current is needed to keep the silicon controlled rectifier turned on, wherein the working current is larger than the basic current.

6. The lighting apparatus of claim 4, wherein the working current keeps the silicon controlled rectifier turned on when the volume of the filtered AC power less than the threshold.

7. The lighting apparatus of claim 1, wherein the maintainer circuit comprises a compatible circuit and a maintaining power circuit, wherein the maintaining power circuit receives the DC power to generate the working current.

8. The lighting apparatus of claim 7, wherein the compatible circuit comprises a capacitor and a resistor connected in series.

9. The lighting apparatus of claim 1, wherein the on-off pattern is a series of predetermined turn-on and turn-off operations applied to the wall switch.

10. The lighting apparatus of claim 9, wherein the series of predetermined turn-on and turn-off operations are performed within an operation time period.

11. The lighting apparatus of claim 9, wherein there are multiple sets of the on-off patterns corresponding to multiple settings for operating the multiple LED modules.

12. The lighting apparatus of claim 9, wherein a different time gap between turn-on and turn-off operations of the wall switch is associated to the different mixed light parameters.

13. The lighting apparatus of claim 9, wherein the mixed light parameter is a color temperature setting.

14. The lighting apparatus of claim 9, wherein the mixed light parameter is a color setting.

15. The lighting apparatus of claim 1, wherein the current source circuit has a controller for determining the multiple driving currents according to a table, wherein the table records parameters of the silicon controlled rectifier and the on-off pattern.

16. The lighting apparatus of claim 15, wherein the table is adjustable according to different silicon controlled rectifiers and different LED modules.

17. The lighting apparatus of claim 15, wherein the current source circuit automatically adjusts the table according to the connected silicon controlled rectifier when the current source circuit is in a reset procedure.

18. The lighting apparatus of claim 1, wherein a bypass path is connected to the rectifier and the input AC power to selectively bypass the silicon controlled rectifier.

19. The lighting apparatus of claim 1, wherein the silicon controlled rectifier is a TRIAC component.

20. The lighting apparatus of claim 1, further comprising a wireless circuit for receiving an external command to bypass an operation of the wall switch.

* * * * *